United States Patent [19]

Nakatsuno et al.

[11] Patent Number: 4,901,534

[45] Date of Patent: Feb. 20, 1990

[54] DEFROSTING CONTROL OF AIR-CONDITIONING APPARATUS

[75] Inventors: Eiji Nakatsuno; Yasunori Himeno; Koji Murozonon Kusatsu, both of Ootsu, all of Japan

[73] Assignee: Matsushita Electric Industrial Co., Ltd., Osaka, Japan

[21] Appl. No.: 137,026

[22] Filed: Dec. 23, 1987

[30] Foreign Application Priority Data

Dec. 26, 1986 [JP] Japan ..... 61-312281

[51] Int. Cl.[4] ..... F25D 21/06

[52] U.S. Cl. ..... 62/81; 62/155; 62/196.4; 62/234; 62/228.4; 62/278

[58] Field of Search ..... 62/228.4, 231, 217, 62/193, 196.3, 196.4, 197, 81, 278, 160, 215, 151, 155, 156, 234, 186, 180, 181, 183, 222, 223, 204, 205

[56] References Cited

U.S. PATENT DOCUMENTS

| | | | |
|---|---|---|---|
| 3,126,712 | 3/1964 | Gebert | 62/160 X |
| 3,332,251 | 7/1967 | Watkins | 62/278 X |
| 3,350,895 | 11/1967 | Harnish | 62/278 X |
| 3,392,542 | 7/1968 | Nussbaum | 62/278 X |
| 4,215,554 | 8/1980 | Pohl | 62/156 |
| 4,270,361 | 6/1981 | La Barge | 62/217 X |
| 4,404,811 | 9/1983 | Mount et al. | 62/193 X |

OTHER PUBLICATIONS

Muruozono et al, Progress in the Design and Construction of Refrigeration Systems, Aug. 1986, Institute of Refrigeration, Paris, "New Defrosting System for Residential Heat Pumps", pp. 289–297.

Japan Refrigeration Association Lecture Report S59–11, p. 53.

*Primary Examiner*—Harry B. Tanner

*Attorney, Agent, or Firm*—Pollock, VandeSande & Priddy

[57] ABSTRACT

A method for controlling an air-conditioning apparatus in terms of execution of the defrosting mode. The apparatus basically includes a variable-frequency compressor, a room heat-exchanger for performing heat-exchange with a room fan, and an outdoor heat-exchanger provided at the outside of the room, which are circularly coupled to each other to establish a refrigerating cycle. Also included in the air conditioning apparatus are a bypass circuit provided between a first line for effecting a connection between an outlet side of the compressor and the room heat-exchanger and a second line for effecting a connection between an inlet side of the compressor and the outdoor heat-exchanger and a restriction device arranged to allow a change of its restriction amount and provided between the two heat-exchanger. The bypass circuit has an opening and closing valve for shutting off the bypass circuit. In response to start of a defrosting mode for defrosting the outdoor heat-exchanger, the restriction amount of the restriction device is controlled so as to be reduced as compared with that on the heating mode, the opening and closing valve is opened for establishing communication between the first and second lines, and further the compressor is controlled so that its operating frequency is increased stepwise up to a predetermined value desirable for the defrosting mode.

6 Claims, 4 Drawing Sheets

DEFROSTING CONTROL OF AIR-CONDITIONING APPARATUS

BACKGROUND OF THE INVENTION

The present invention relates generally to a heat-pump type air-conditioning apparatus and control method therefore, and more particularly to defrosting control of an outdoor heat exchanger of such a heat-pump type air-conditioning apparatus.

Generally, as a system for defrosting frost attached to an outdoor heat exchanger of a heat-pump type air-conditioning apparatus is known the so-called reverse-cycle defrosting system in which valve switching is formed so that the outdoor heat exchanger is used as a condenser and the room heat exchanger is used as an evaporator. Problems with this system are that the defrosting time is long because of small refrigerant circulation and heating has to be stopped during the defrosting operation and further a long time is required to elevate the temperature of the room heat exchanger after termination of the defrosting operation.

Attempts to avoid the problems noted above have been made heretofore, such a technique being disclosed as the so-called hot-gas bypass defrosting system in "Japan Refrigeration Association Lecture Report" S59-11, Page 53, for example, in which a portion of the delivery gas from the compressor is supplied by a predetermined quantity to the room heat exchanger for keeping a slight heating capability and the remainder of the delivery gas therefrom is introduced into the outlet side of the outdoor heat exchanger for further performing defrosting. Although satisfactory for elimination of the above-mentioned problems, such a defrosting system has disadvantages, an important one of which relates to reduction of the oil level within the compressor and reduction of reliability of the compressor attendant thereupon. More specifically, as shown in FIG. 5, in response to start of the defrosting operation, the operating frequency of the compressor is arranged to be quickly increased from a frequency immediately before the start of the defrosting operation to the maximum operating frequency and a portion of high-temperature delivery gas is bypassed through a bypass line to the outlet side of the outdoor heat exchanger. Therefore, the pressure difference between both the sides of the outdoor heat exchanger is momentarily reduced as shown in FIG. 6 and, as a result, the refrigerant is formed under the low pressure condition and the oil of the compressor is discharged together with the refrigerant to the outside of the compressor to result in abrupt reduction of the oil level. In addition, when the operating frequency of the compressor is then increased at a stretch to the maximum operating frequency, the oil thereof is further discharged so as to cause further reduction of the oil level, resulting in lowering of reliability of the compressor. Thus, a further improvement of the hot-gas bypass defrosting system would be required from the viewpoint of improvement of reliability of the compressor.

SUMMARY OF THE INVENTION

The present invention has been developed in order to remove the above-mentioned drawbacks inherent to the hot-gas bypass defrosting systems of conventional heat-pump type air-conditioning apparatus.

It is therefore an object of the present invention to provide a new and improved control method of a heat-pump type air-conditioning apparatus which is capable of preventing abrupt reduction of the oil of a compressor. For achieving the purpose, the operating frequency of the compressor is increased stepwise up to a predetermined value desirable for the defrosting in response to start of the defrosting mode.

Another feature of the present invention is that in response to switching from the defrosting mode to the heating mode, the operating frequency of the compressor is once reduced to a predetermined value for preventing abrupt application of a load to the compressor on the mode change.

A further feature of the present invention is that during the defrosting mode the air-supply amount of a room fan is reduced for preventing abrupt variation of temperature within the room, preventing reduction of pressure of a refrigerant returning to the compressor so as to increase the temperature of the return refrigerant, resulting in shortening the defrosting time.

In accordance with the present invention, there is provided a method for controlling an air-conditioning apparatus including a variable-frequency compressor arranged to allow a change of its operating frequency, a room heat-exchanger provided in a room to be heated for heat-exchange with a room fan for supplying into the room air heat-exchanged with the room heat-exchanger, and an outdoor heat-exchanger provided at the outside of the room, which are circularly coupled to each other to establish a refrigerating cycle, the air-conditioning apparatus further including a bypass circuit provided between a first line for effecting a connection between an outlet side of the variable-frequency compressor and the room heat-exchanger and a second line for effecting a connection between an inlet side of the variable-frequency compressor and the outdoor heat-exchanger and a restriction device arranged to allow a change of its restriction amount and provided between the room heat-exchanger and the outdoor heat-exchanger, the bypass circuit having an opening and closing valve for shutting off the bypass circuit, the method comprising the steps of: (a) controlling the restriction amount of the restriction device in response to start of a defrosting mode of the air-conditioning apparatus for defrosting the outdoor heat-exchanger, the restriction amount thereof being reduced as compared with a restriction amount thereof during a heating mode of the air-conditioning apparatus for heating the room; (b) opening the opening and closing valve of the bypass circuit in response to the start of the defrosting mode for establishing communication between the first and second lines; and (c) controlling the variable-frequency compressor in response to the start the defrosting mode so that its operating frequency is increased stepwise up to a predetermined value desirable for the defrosting mode.

In accordance with the present invention, there is further provided a method for controlling an air-conditioning apparatus including a variable-frequency compressor arranged to allow a change of its operating frequency, a room heat-exchanger provided in a room to be heated for heat-exchange with a room fan for supplying into the room air heat-exchanged with the room heat-exchanger; and an outdoor heat-exchanger provided at the outside of the room, which are circularly coupled to each other to establish a refrigerating cycle, the air-conditioning apparatus further including a bypass circuit provided between a first line for effecting a connection between an outlet side of the variable-frequency compressor and the room heat-exchanger and a second line for effecting a connection between the outlet side of the variable-frequency compressor and the outdoor heat-exchanger and a restriction device arranged to allow a change of its restriction amount and provided between the room heat-exchanger and the outdoor heat-exchanger, the bypass circuit having an opening and closing valve for shutting off the bypass circuit, the method comprising the steps of: (a) controlling the restriction amount of the restriction device in response to start of a defrosting mode of the air-conditioning apparatus for defrosting the outdoor heat-exchanger, the restriction amount thereof being reduced as compared with a restriction amount thereof during a heating mode of the air-conditioning apparatus for heating the room; (b) opening the opening and closing valve of the bypass circuit in response to the start of the defrosting mode for establishing communication between the first and second lines; and (c) reducing the air-supply amount of the room fan in response to the start of the defrosting mode as compared with an air-supply amount thereof during the heating mode.

In accordance with the present invention, there is still further provided an air-conditioning apparatus comprising: a variable-frequency compressor arranged to allow a change of its operating frequency; a room heat-exchanger coupled to an outlet side of the variable-frequency compressor and provided in a room to be heated for heat-exchange with a room fan for supplying into the room air heat-exchanged with the room heat-exchanger; an outdoor heat-exchanger coupled between the room heat-exchanger and an inlet side of the variable-frequency compressor and provided at the outside of the room; a bypass circuit provided between a first line for effecting a connection between the outlet side of the variable-frequency compressor and the room heat-exchanger and a second line for effecting a connection between the inlet side of the variable-frequency compressor and the outdoor heat-exchanger, the bypass circuit having an opening and closing valve for shutting off the bypass circuit; a restriction device arranged to allow a change of its restriction amount and provided between the room heat-exchanger and the outdoor heat-exchanger for restricting a communication of a refrigerant therebetween; and a control unit for (a) determining execution of a defrosting mode for defrosting the outdoor heat-exchanger on the basis of a temperature of the outdoor heat-exchanger, (b) controlling the restriction amount of the restriction device in response to the determination of the defrosting mode, the restriction amount thereof being reduced as compared with a restriction amount thereof during a heating mode for heating said room, (c) opening the opening and closing valve of the bypass circuit in response to the determination of the defrosting mode for establishing communication between the first and second lines, (d) reducing the air-supply amount of the room fan in response to the determination of the defrosting mode as compared with an air-supply amount thereof during the heating mode, and (e) controlling the variable-frequency compressor in response to the determination of the defrosting mode so that its operating frequency is increased stepwise up to a predetermined value desirable for the defrosting mode.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
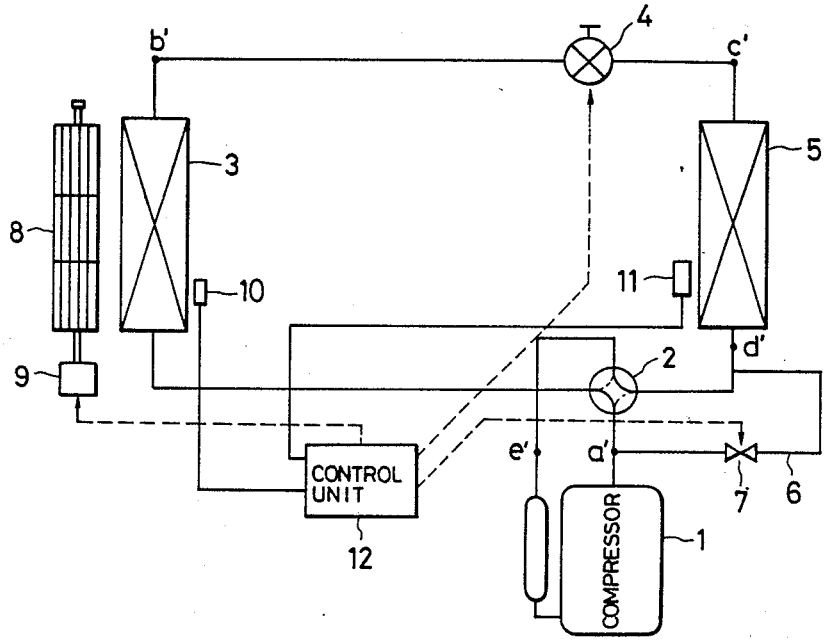
FIG. 1 is a block diagram showing a heat-pump type air-conditioning apparatus for an embodiment of the present invention.

Referring now to FIG. 1, there is illustrated a heat-pump type air-conditioning apparatus, the present invention being incorporated thereinto. In FIG. 1, the heat-pump type air-conditioning apparatus comprises a variable frequency compressor 1, a room heat exchanger 3 and an outdoor heat exchanger 5 which are coupled to each other so as to form a circulation. The output side of the variable frequency compressor 1 is coupled through a four-way valve 2 to the room heat exchanger 3 which is in turn coupled through an electric expansion valve 4 to the outdoor heat exchanger 5. The electric expansion valve 4 is arranged so that its opening degree is controllable in response to an electromagnetic force to be applied. The outdoor heat exchanger 5 is coupled through the four-way valve 2 to the input side of the compressor 1. Also included in the heat-pump type air-conditioning apparatus is a control unit 12 which, may be constructed of a known microcomputer comprising a central processing unit (CPU) and memories, which is coupled to a room temperature detecting device 10 for detecting the temperature of the room heat exchanger 3 and generating a detection signal and an outdoor temperature detecting device 11 for detecting the temperature of the outdoor heat exchanger 5 and generating a detection signal. The control unit 12 is responsive to the detection signals from the room temperature detecting device 10 and the outdoor temperature detecting device 11 for controlling the opening degree, or restriction amount, of the electric expansion valve 4 and the operating frequency of the compressor 1. This heat-pump type air-conditioning apparatus further comprises a bypass circuit (line) 6 which has an opening and closing valve, i.e., two-way valve, 7 and is provided between the outlet side of the compressor 1 and the outdoor heat exchanger 5. A description will be omitted in terms of the arrangement of each of the compressor 1, room heat exchanger 3, electric expansion valve 4 and outdoor heat exchanger 5, because of being known, for brevity. On the normal heating operation of the heat-pump type air-conditioning apparatus, the opening and closing valve 7 is kept in the closed state in response to an instruction signal from the control unit 12 and therefore the refrigerant circulation (heating cycle) is performed so that a refrigerant flows from the compressor 1 through the four-way valve 2, room heat exchanger 3, electric expansion valve 4, outdoor heat exchanger 5 and four-way valve 2 thereinto. At this time, a room fan 8 is driven through a variable-speed motor 9 by the control unit 12 so as to provide hot air with a desired quantity into the room, the room fan 8 being arranged to emit into the room air obtained by heat-exchange with the room heat exchanger 3. A more detailed description of the heating cycle will be omitted because the important point of the present invention is the defrosting technique.

A description will hereinbelow be made in terms of a defrosting cycle according to an embodiment of the present invention. When frost is attached to the outdoor heat exchanger 5 due to lowering of the outside temperature, the heating operation of the air-conditioning apparatus is switched to the defrosting operation, the switching being performed by the control unit 12 on the basis of the temperature-detection signal from the outdoor temperature detecting device 11. The control unit 12 generates a defrosting-start instruction signal in response to the outdoor temperature becoming below a predetermined value so that the opening and closing valve 7 is opened with the four-way valve 2 remaining as it is. Because of the opening of the opening and closing valve 7, the high-temperature discharge gas from the compressor 1 is branched at a point a′ into two ways. That is, a portion of the discharge gas is supplied continuously to the room heat exchanger 3 and the remainder thereof is introduced into the outlet side of the outdoor heat exchanger 5. At this time, the control unit 12 generates control signals toward the electric expansion valve 4 and the drive motor 9 so that the opening degree of the electric expansion valve 4 is set substantially to the maximum, that is, the restriction amount becomes substantially zero, and the speed of the drive motor 9 is reduced, as compared with the speed during the heating operation, to make smaller the air quantity supplied into the room.

Figure 2:
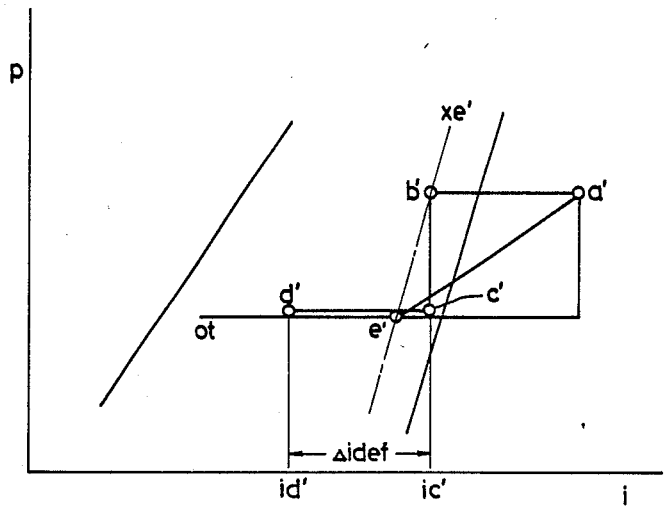
FIG. 2 is a Mollier diagram of a defrosting operation of the FIG. 1 air-conditioning apparatus.

FIG. 2 shows a Mollier diagram wherein characters a′ to e′ correspond to the positions a′ to e′ of FIG. 1. On the defrosting operation, the high-temperature gas supplied though the point a′ is condensed and heat-radiated at a relatively low temperature (about 30° to 40° C.) because the electric expansion valve 4 is set to the full open state and then reaches the point b′. At this time, the room fan 8 is driven at a low speed so that the heating operation can be kept continuously. After being slightly pressure-reduced due to the pipe and the electric expansion valve 4, the high-temperature gas reaches the points c′ and then flows into the outdoor heat exchanger 5 where the gas is condensed and heat-radiated at the temperature of about 0° C. which is equal to the frost-fusing temperature. After passing through the outdoor heat exchanger 5, the gas reaches the point d′. The enthalpy difference of the refrigerant used at this time for the defrosting can be expressed as $\Delta i_{def} = i_c' - i_d'$ and the refrigerant flowing into the outdoor heat exchanger 5 assumes a two-phase state as indicated by c′. Here, the enthalpy difference of the refrigerant used for the heating is $i_a' - i_b'$ under that condition that the heat loss on the way is negligible. On the other hand, the remainder of the discharge gas from the compressor 1 is introduced into the outlet side of the outdoor heat exchanger 5 and, after the substantial same variation of enthalpy occurs, combined with the refrigerant from the outdoor heat exchanger 5 whose liquid component is much and reaches the point e′ and is introduced into the compressor 1. Although the point e′ assumes a two-phase state, the dryness $x'_e$ of the refrigerant at this point e′ is high and the liquid component thereof is little and therefore it is possible to reduce or substantially prevent the liquid return and liquid compression. Furthermore, since the refrigerant introduced into the outdoor heat exchanger 5 during the defrosting operation basically assumes a two-phase state, the refrigerant temperature, i.e., the surface temperature of the outdoor heat exchanger 5, becomes constant and uniform, resulting in uniform defrosting.

Figure 3:
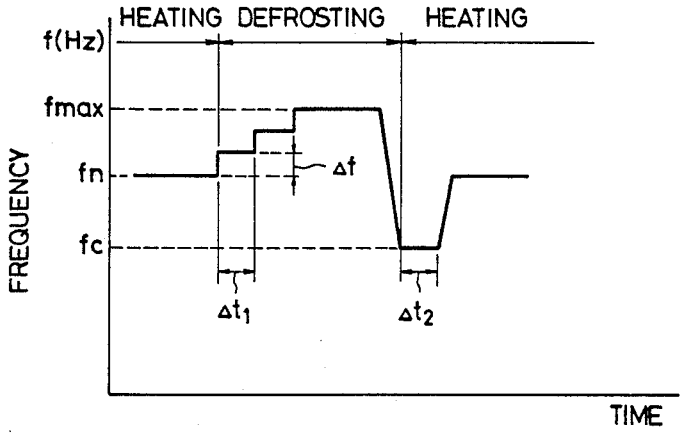
FIG. 3 is a graphic diagram illustrating control of the operating frequency of the FIG. 1 air-conditioning apparatus.
Figure 4:
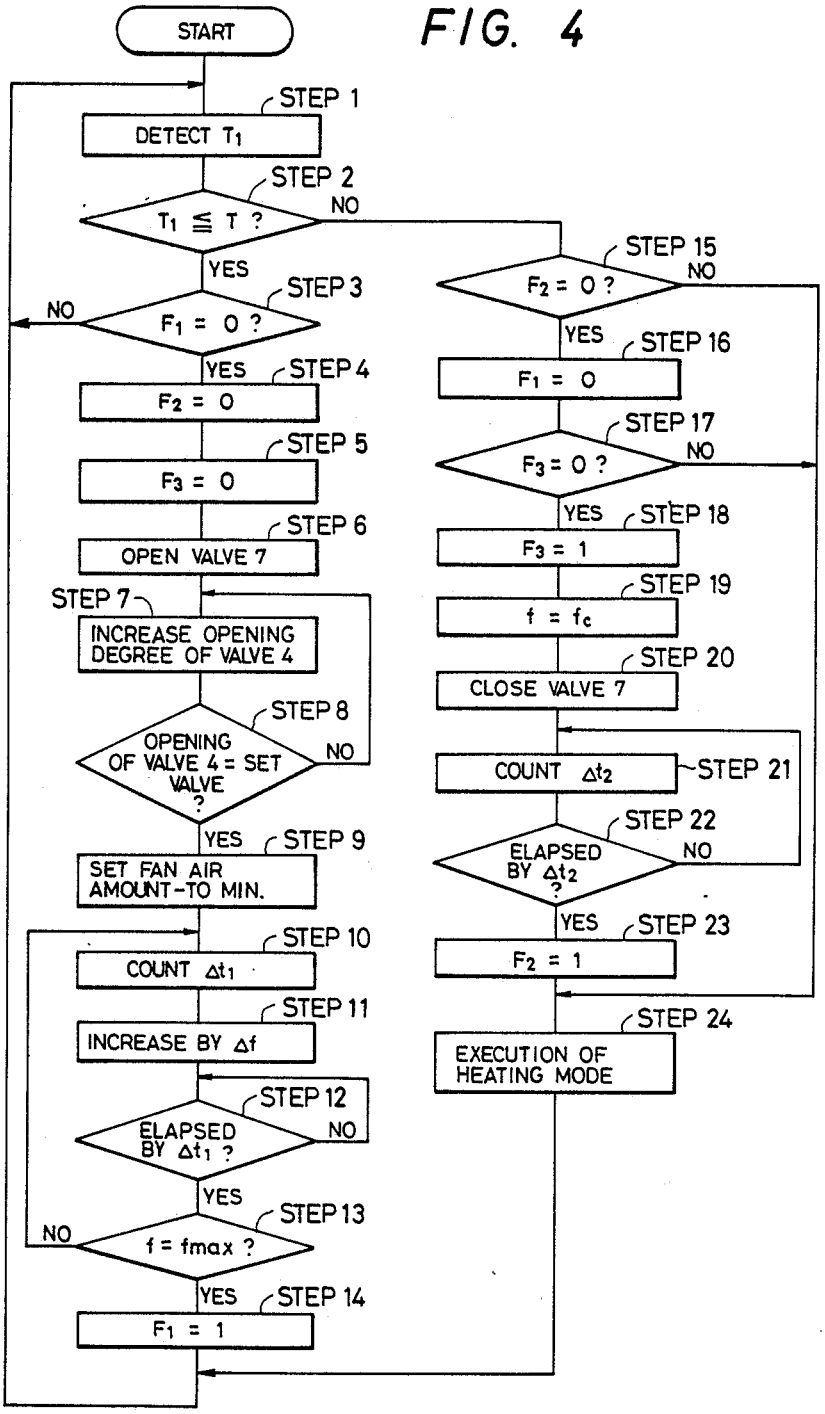
FIG. 4 is a flow chart for describing control of the FIG. 1 air-conditioning apparatus.
Figure 5:
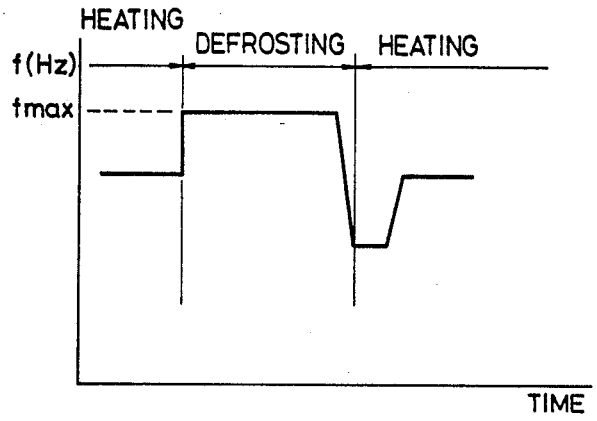
FIG. 5 PRIOR ART
FIGS. 5 and 6 are graphic illustrations for describing a conventional air-conditioning apparatus.
Figure 6:
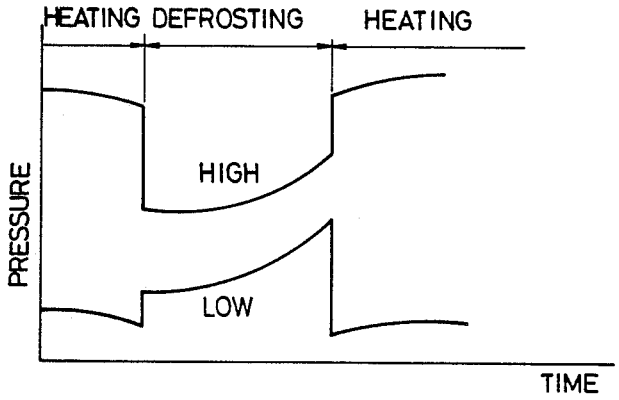
FIG. 6 PRIOR ART

FIG. 3 is a graphic diagram showing control of the operating frequency of the compressor 1 wherein illustrated are the frequency immediately before the defrosting operation, the frequency during the defrosting operation and the frequency after the defrosting operation. That is, operation is switched from a heating mode in which the compressor 1 is driven with an operating frequency fn corresponding to the room temperature to a defrosting mode and then again switched to a heating mode. A description of the operating frequency control will hereinbelow be made with reference to a flow chart of FIG. 4. During the heating operation, the control unit 12 reads a detection signal indicative of the temperature T1 of the outdoor heat exchanger 5 from the outdoor heat exchanger 5 (step 1) and compares the temperature T1 with a reference temperature T in order to determine execution of the defrosting operation (step 2). When $T1 \leqq T$, control proceeds to a step 3 to check whether a flag F1 indicative of defrosting start is set, that is, whether F1=0. If F1=1, the operational flow returns to the step 1. If F1=0, control goes to a subsequent step 4 to release the present heating operation and set a flag F2 to F2=0 , followed by a step 5 to release a return timer which will be described hereinafter and to set a flag F3 to F3=0. After execution of the step 5, the defrosting operation is performed through steps 6 through 14. That is, the opening and closing valve 7 is opened (step 6) and the opening degree of the electric expansion valve 4 is increased up to a predetermined value (substantially full-opened) (step 7). The opening degree of the expansion valve 4 is checked at the step 8 and, when opened to the predetermined value, control goes to the step 9 where the drive motor 9 is controlled so that the air delivery quantity of the room fan 8 assumes the minimum. Thereafter, the step 10 is executed to start a defrosting timer to count Δt1 and at the same time the step 11 is executed to increase the operating frequency f of the drive motor of the compressor 1 by Δf. After elapsed by the time Δt1 (step 12), the operating frequency is additionally increased by Δf and the defrosting timer again counts Δt1. This stepwise frequency-increasing operation is repeatedly performed until the operating frequency reaches the maximum frequency fmax. In the step 13, it is checked whether f=fmax. If so, the flag F1 is set to 1 in the step 14 to indicate the defrosting mode. The operational flow returns to the step 1 after termination of the step 14 so that the same processes are performed from the start.

On the other hand, in response to T1>T in the step 2 due to increase in the temperature of the outdoor heat exchanger 5, the operation is switched from the defrosting mode to a heating mode through steps 15 to 24. That is, first, control goes to the step 15 to check whether the flag F2 indicative of the heating mode is in the F2=0 state. If so, the defrosting mode is cleared in the step 16 whereby the flag Fl is reset to 0, followed by the step 17 to check whether the return timer is kept in the reset state and, if so, followed by the step 18 where the return timer is prepared so as to allow start of counting. Control then goes to the step 19 so that the compressor 1 is operated at a predetermined return frequency fc and advances to the step 20 where the opening and closing valve 7 is closed. The subsequent step 21 is executed so that the return timer counts a heating-return time Δt2 and the count value is checked in the step 22. When elapsed by Δt2, the step 23 is executed to set the flag F2 to F1=1 for indication of the heating mode state. After termination of the step 23, at the step 24, the control unit 12 performs control for the heating mode, i.e., room temperature detection, determination of the operating frequency corresponding to the room temperature, the drive of the room fan 8 and so on. With respect to the above-described defrosting processes, it is preferred according to experimental results that Δt1 is about 20 to 30 seconds, Δt2 is about 30 to 60 seconds, and Δf is about 5 Hz. The sequence of the steps is not limited to the illustration of FIG. 4 and the changes of the sequence thereof may be made if required.

In this embodiment of the invention, the restriction amount, i.e., opening degree, of the electric expansion valve 4 during the defrosting operation is reduced as compared with the restriction amount thereof on the heating operation. This prevents lowering of the temperature of the refrigerant flowing into the outdoor heat exchanger 5, resulting in reduction of time required for the defrosting.

As described above, according to the embodiment of the present invention, since the operating frequency of the compressor 1 is not increased at a stretch from the frequency immediately before the defrosting start to the maximum but increased stepwise, it is possible to prevent reduction of the level of oil within the compressor 1 and further prevent the liquid return and liquid compression unlike the conventional air-conditioning apparatus. In addition, since the heating operation is allowed continuously irrespective of execution of the defrosting operation, it is possible to prevent abrupt variation of the room temperature.

It should be understood that the foregoing relates to only a preferred embodiment of the present invention, and that it is intended to cover all changes and modifications of the embodiment of the invention herein used for the purposes of the disclosure, which do not constitute departures from the spirit and scope of the invention. For example, although in the above-description the restriction device is constructed of the electric expansion valve 4 whose opening degree is controllable by an electromagnetic force, it is also appropriate to use a plurality of capillary tubes which are arranged so as to allow control of the restriction amount.

What is claimed is:

1. A method for controlling an air-conditioning apparatus including a variable-frequency compressor arranged to allow a change of its operating frequency, a room heat-exchanger provided in a room to be heated for heat-exchange with a room fan for supplying into said room air heat-exchanged with said room heat-exchanger, and an outdoor heat-exchanger provided at the outside of said room, which are circularly coupled to each other to establish a refrigerating cycle, said air-conditioning apparatus further including a bypass circuit provided between a first line for effecting a connection between an outlet side of said variable-frequency compressor and said room heat-exchanger and a second line for effecting a connection between an inlet side of said variable-frequency compressor and said outdoor heat-exchanger and a restriction device arranged to allow a change of its restriction amount and provided between said room heat-exchanger and said outdoor heat-exchanger, said by pass circuit having an opening and closing valve for shutting off said bypass circuit, the method comprising the steps of:

(a) controlling the restriction amount of said restriction device in response to start of a defrosting mode of said air-conditioning apparatus for defrosting said outdoor heat-exchanger, the restriction amount thereof being reduced as compared with a restriction amount thereof during a heating mode of said air-conditioning apparatus for heating said room;

(b) opening said opening and closing valve of said bypass circuit in response to the start of said defrosting mode for establishing communication between said first and second lines;

(c) controlling said variable-frequency compressor in response to the start of said defrosting mode so that its operating frequency is increased stepwise up to a first predetermined value desirable for said defrosting mode; and (d) reducing the operating frequency of said compressor to a second predetermined value in response to termination of said defrosting mode and operating said compressor at the operating frequency of said second predetermined value for a first predetermined time period.

2. A method as claimed in claim 1, wherein the step (c) comprises repeatedly increasing the operating frequency of said compressor by a predetermined amount for a second predetermined time period so that the operating frequency thereof finally reaches the first predetermined value, said operating frequency initially taking a third predetermined value at the start of the defrosting mode and the third predetermined value being between said first and second predetermined value.

3. A method for controlling an air-conditioning apparatus including a variable-frequency compressor arranged to allow a change of its operating frequency, a room heat-exchanger provided in a room to be heated for heat-exchange with a room fan for supplying into said room air heat-exchanged with said room heat-exchanger, and an outdoor heat-exchanger provided at the outside of said room, which are circularly coupled to each other to establish a refrigerating cycle, said air-conditioning apparatus further including a bypass circuit provided between a first line for effecting a connection between an outlet side of said variable-frequency compressor and said room heat-exchanger and a second line for effecting a connection between an inlet side of said variable-frequency compressor and said outdoor heat-exchanger and a restriction device arranged to allow a change of its restriction amount and provided between said room heat-exchanger and said outdoor heat-exchanger, said bypass circuit having an opening and closing valve for shutting off said bypass circuit, the method comprising the steps of:

(a) controlling the restriction amount of said restriction device in response to start of a defrosting mode of said air-conditioning apparatus for defrosting said outdoor heat-exchanger, the restriction amount thereof being reduced as compared with a restriction amount thereof during a heating mode of said air-conditioning apparatus for heating said room;

(b) opening said opening and closing valve of said bypass circuit in response to the start of said defrosting mode for establishing communication between said first and second lines;

(c) reducing the air-supply amount of said room fan in response to the start of said defrosting mode as compared with an air-supply amount thereof during said heating mode;

(d) controlling said variable-frequency compressor in response to the start of said defrosting mode so that its operating frequency is increased stepwise up to a first predetermined value desirable for said defrosting mode; and (e) reducing the operating frequency of said compressor to a second predetermined value in response to termination of said defrosting mode and operating said compressor at the operating frequency of said second predetermined value for a first predetermined time period.

4. A method as claimed in claim 3, wherein the step (d) comprises repeatedly increasing the operating frequency of said compressor by a predetermined amount for a second predetermined time period so that the operating frequency thereof finally reaches the first predetermined value after the elapse of a third predetermined time period, said operating frequency initially taking a third predetermined value at the start of the defrosting mode and the third predetermined value being between said first and second predetermined values.

5. An air-conditioning apparatus comprising:

a variable-frequency compressor arranged to allow a change of its operating frequency;

a room heat-exchanger coupled to an outlet side of said variable-frequency compressor and provided in a room to be heated for heat-exchange with a room fan for supplying into said room air heat-exchanged with said room heat-exchanger;

an outdoor heat-exchanger coupled between said room heat-exchanger and an inlet side of said variable-frequency compressor and provided at the outside of said room;

a bypass circuit provided between a first line for effecting a connection between the outlet side of said variable-frequency compressor and said room heat-exchanger and a second line for effecting a connection between the inlet side of said variable-frequency compressor and said outdoor heat-exchanger, said bypass circuit having an opening and closing valve for shutting off said bypass circuit;

a restriction device arranged to allow a change of its restriction amount and provided between said room heat-exchanger and said outdoor heat-exchanger for restricting a communication of a refrigerant therebetween; and a control unit for (a) determining execution of a defrosting mode for defrosting said outdoor heat-exchanger on the basis of a temperature of said outdoor heat-exchanger, (b) controlling the restriction amount of said restriction device in response to the determination of said defrosting mode, the restriction amount thereof being reduced as compared with a restriction amount thereof during a heating mode for heating said room, (c) opening said opening and closing valve of said bypass circuit in response to the determination of said defrosting mode for establishing communication between said first and second lines, (d) reducing the air-supply amount of said room fan in response to the determination of said defrosting mode as compared with an air-supply amount thereof during said heating mode, (e) controlling said variable-frequency compressor in response to the determination of said defrosting mode so that its operating frequency is increased stepwise up to a first predetermined value desirable for said defrosting mode, and (f) reducing the operating frequency of said compressor to a second predetermined value in response to termination of said defrosting mode and operating said compressor at the operating frequency of said second predetermined value for a first predetermined time period.

6. An air-conditioning apparatus as claimed in claim 5, wherein said control unit in the step (e) controls said compressor so as to repeatedly increase the operating frequency of said compressor by a predetermined amount for a second predetermined time period so that the operating frequency thereof finally reached the first predetermined value after the lapse of a third predetermined time period, said operating frequency initially taking a third predetermined value at the start of the defrosting mode and the third predetermined value being between said first and second predetermined value.

* * * * *

UNITED STATES PATENT AND TRADEMARK OFFICE

CERTIFICATE OF CORRECTION

PATENT NO. : 4,901,534

DATED : February 20, 1990

INVENTOR(S) : Eiji Nakatsuno, et al.

It is certified that error appears in the above-identified patent and that said Letters Patent is hereby corrected as shown below:

On the title page, the listing of inventors should read:

--Eiji Nakatsuno; Yasunori Himeno, both of Ootsu; Koji Murozono, of Kusatsu, all of Japan--.

Signed and Sealed this

Thirtieth Day of July, 1991

*Attest:*

HARRY F. MANBECK, JR.

*Attesting Officer*

*Commissioner of Patents and Trademarks*